US005083907A

United States Patent [19]

Brownell

[11] Patent Number: 5,083,907

[45] Date of Patent: Jan. 28, 1992

[54] ROOTS-TYPE BLOWER WITH IMPROVED INLET

[75] Inventor: E. Scott Brownell, Marshall, Mich.

[73] Assignee: Eaton Corporation, Cleveland, Ohio

[21] Appl. No.: 528,529

[22] Filed: May 25, 1990

[51] Int. Cl.[5] ..... F04B 49/02; F04C 18/16; F04C 29/08

[52] U.S. Cl. ..... 417/440; 418/201.1; 418/201.2; 418/206

[58] Field of Search ..... 418/201.1, 206, 201.2; 417/310, 440

[56] References Cited

U.S. PATENT DOCUMENTS

| | | | |
|---|---|---|---|
| 2,287,716 | 6/1942 | Whitfield | 230/143 |
| 2,457,314 | 12/1948 | Lysholm | 418/201.1 |
| 2,480,818 | 8/1949 | Whitfield | 103/128 |
| 2,642,003 | 6/1953 | Whitfield | 418/201.1 |
| 2,654,530 | 10/1953 | Oldberg | 230/143 |
| 2,983,226 | 5/1961 | Livermore | 417/310 |
| 3,073,514 | 1/1963 | Bailey et al. | 230/205 |
| 3,283,996 | 11/1966 | Schibbye | 230/143 |
| 4,502,283 | 3/1985 | Wandel | 417/310 |
| 4,595,349 | 6/1986 | Preston et al. | 418/206 |
| 4,684,335 | 8/1987 | Goodridge | 418/189 |
| 4,768,934 | 9/1988 | Soeters | 418/1 |
| 4,828,467 | 5/1989 | Brown | 418/201 |
| 4,844,044 | 7/1989 | McGovern | 123/559.1 |

FOREIGN PATENT DOCUMENTS

| | | | |
|---|---|---|---|
| 58-214684 | 12/1983 | Japan | 417/440 |

OTHER PUBLICATIONS

SAE Technical Paper Series No. 870355 entitled, "Development of the Eaton Supercharger", by Loren H. Uthoff and John W. Yakimow, Feb. 1987.

*Primary Examiner*—John J. Vrablik
*Attorney, Agent, or Firm*—P. S. Rulon

[57] ABSTRACT

A rotary positive displacement blower (10) of the Roots-type includes an improved inlet port opening (28 or 100, or 150) and an inlet duct (30) and a bypass duct (31) formed in a unitary housing member (14).

9 Claims, 5 Drawing Sheets

ROOTS-TYPE BLOWER WITH IMPROVED INLET

CROSS REFERENCE TO RELATED APPLICATION

This application relates to U.S. application Ser. No. 07/528,640, filed May 25, 1990 and assigned to the assignee of this application.

BACKGROUND OF THE INVENTION

As is well known, Roots-type blowers include lobed rotors meshingly disposed in transversely overlapping cylindrical chambers defined by a housing. Spaces between adjacent unmeshed lobes of each rotor transfer volumes of air from an inlet port opening to an outlet port opening without mechanical compression of the air in each space. If the full axial length of the cylindrical wall surfaces of the chambers were to actually intersect, the intersections would form two cusps intermediate the chambers and extending between end walls of the chambers. In actual practice, all or most of the cusps have been removed by inlet and outlet port openings which respectively direct inlet air flow radially inward into the spaces between unmeshed lobes of each rotor and outlet air flow radially outward from the spaces.

U.S. Pat. No. 4,768,934, which is incorporated herein by reference, and many other patents, e.g., U.S. Pat. No. 3,121,529, disclose Roots-type blowers having inlet and outlet port openings extending through the cylindrical walls of the housing for respectively directing all of the inlet and outlet air flow radially inward and radially outward.

The Roots-type blowers disclosed in U.S. Pat. No. 2,654,530 and SAE Technical Paper 870355 have modified inlet port openings wherein the inlet port opening in each extends through an end wall of the chambers. Some of the air from these modified inlet port openings flows axially into the spaces between the rotor lobes. However, most of the inlet air flow is intended to flow radially inward into the spaces from a channel extending axially from the inlet opening.

The above Roots-type blowers have functioned well as superchargers for vehicle engines even though they have suffered from rather poor volumetric efficiency. As taught in the above mentioned SAE Paper, test data therein demonstrated that volumetric efficiency of a Roots-type blower improved, particularly at low rotor speeds, by increasing seal time of the rotor lobes, i.e., the number of rotational degrees the rotor lobes defining each transfer volume are sealed off from the inlet and outlet port openings. As the ports were widened to provide increased flow area needed at high speeds, seal time and efficiency decreased. The inlet port opening disclosed herein provides substantially improved high speed and overall volumetric efficiency without loss of low speed efficiency.

SUMMARY OF THE INVENTION

An object of this invention is to provide a Roots-type blower with an inlet port opening which improves the overall and high speed volumetric efficiency of the blower.

Another object of this invention is to increase the number of rotational degrees that the spaces between unmeshed lobes of each rotor are in communication with the inlet port opening.

Another object of this invention is to provide an inlet port opening which mitigates negative effects of centrifugal forces imparted to inlet air by the rotor lobes.

Another object of this invention is to provide an inlet port opening which mitigates the negative effects air flow from a substantially developed transfer volume to a subsequently developing transfer volume.

According to a feature of the invention, a Roots-type blower comprises a housing assembly defining first and second transversely overlapping cylindrical chambers having internal cylindrical and flat end wall surfaces. The chambers have transversely spaced apart. parallel axes lying in a common plane. An intersection of the cylindrical wall surfaces on one side of the plane defines a cusp extending parallel to the axes. The housing defines inlet and outlet port openings disposed on opposite sides of the plane for respectively directing air to and from the chamber, and the inlet port opening extends through one end wall of the chambers. First and second meshed, lobed rotors are respectively disposed in the chambers for counter rotation about axes substantially coincident with the chamber axes. Each rotor includes at least two lobes having radially inner extents thereof separated by bottom lands. Each lobe has axially facing ends sealingly cooperating with the end wall surfaces and a radially outer extent defining a top land sealingly cooperating with the cylindrical wall surfaces. Circumferential spacing between fore and aft adjacent unmeshed lobes of each rotor defines a transfer volume for transferring air from the inlet port opening to the outlet portion in less than one full rotation of each rotor.

The improvement is characterized by the inlet port opening being disposed on the cusp side of the plane and including radially inner and outer boundaries with respect to the axes, and first and second lateral boundaries each disposed about a minimum of 60 rotational degrees in opposite directions from the cusp, and the radially inner boundary having portions disposed for substantial alignment with the rotating bottom lands of the respective rotors, the radially outer boundary between the lateral boundaries including portions disposed radially outward of a tangent extending across cylindrical surfaces of the chambers, and the cylindrical wall surfaces of the chambers between the lateral boundaries extending axially from the other end wall to within less than 25% of the distance to the one end wall and then tapering radially outward for blending with the portions of the radially outer boundary.

BRIEF DESCRIPTION OF THE DRAWINGS

A Roots-type blower intended for use as a supercharger is illustrated in the accompanying drawings in which.

DETAILED DESCRIPTION OF THE DRAWINGS

Figure 1:
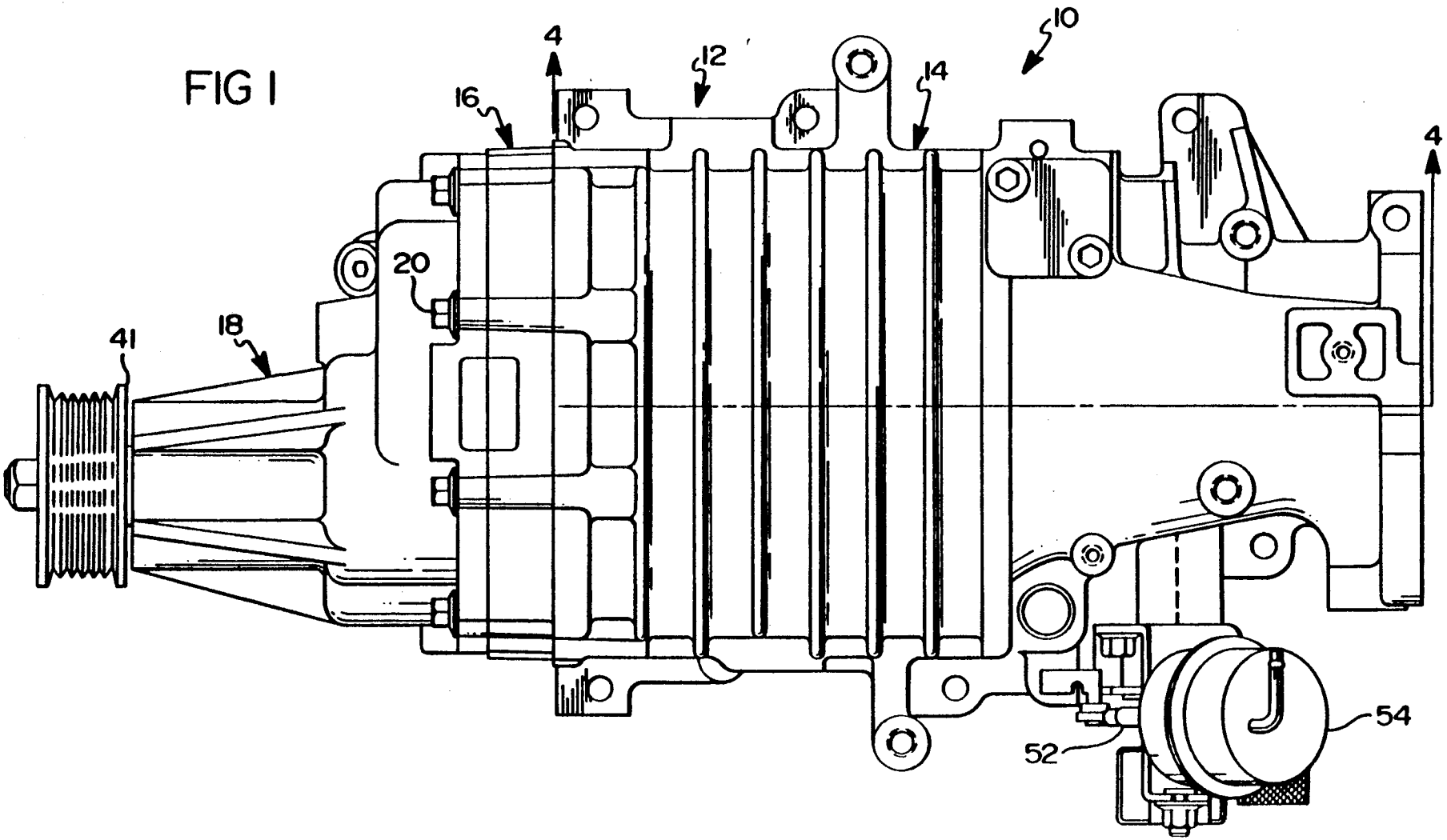
FIGS. 1-3 are relief views of the Roots-type blower with FIG. 1 being a top view, FIG. 2 being a bottom view and FIG. 3 being a side view.
Figure 2:
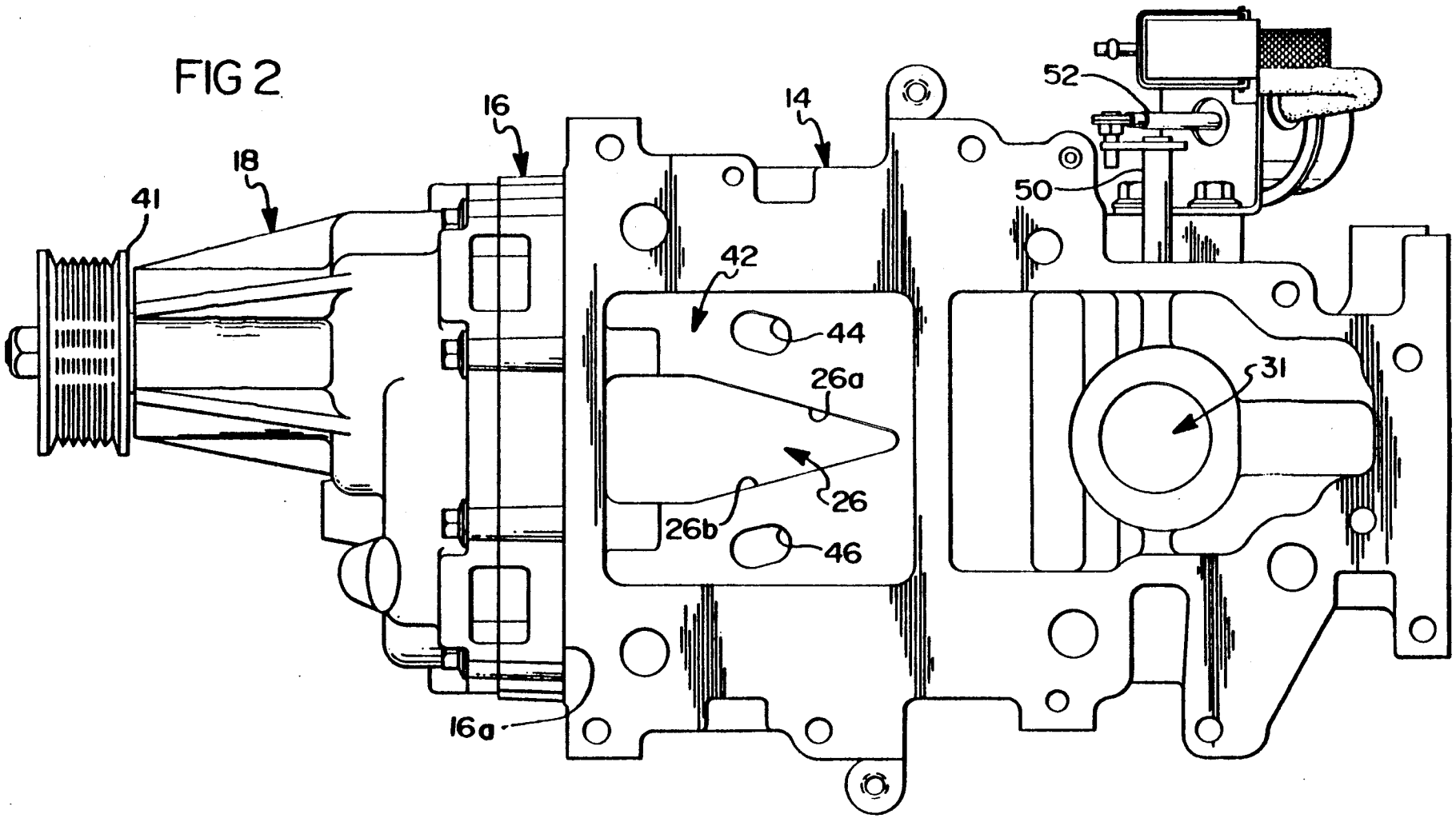
Figure 3:
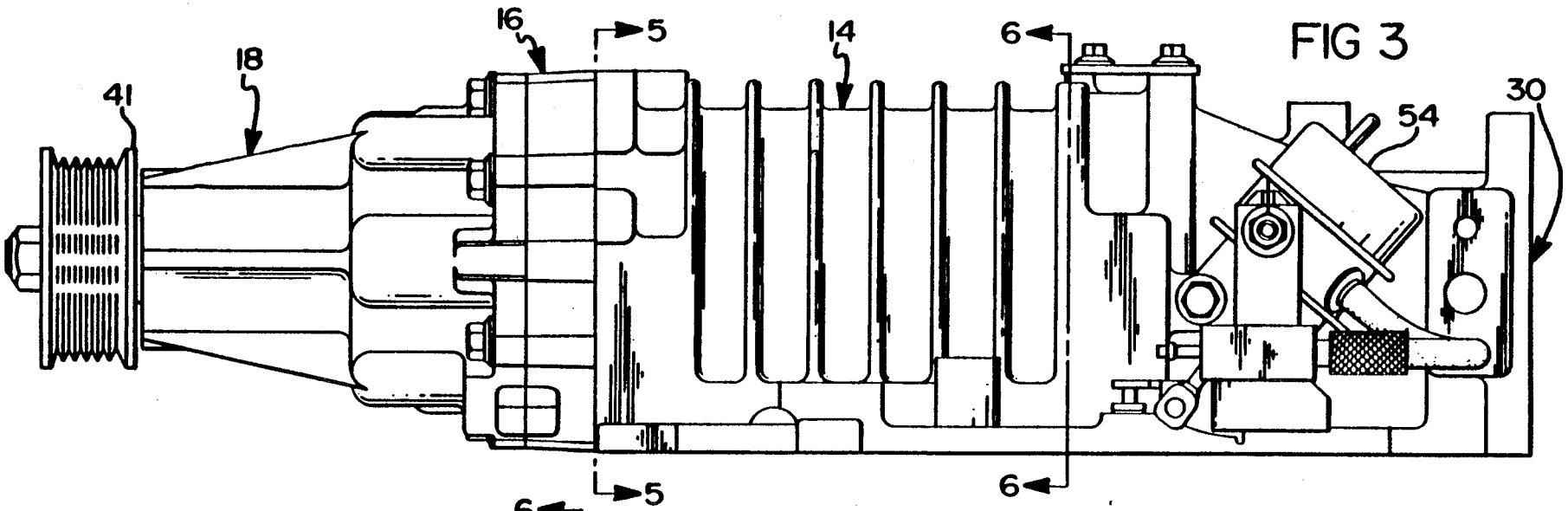
Figure 4:
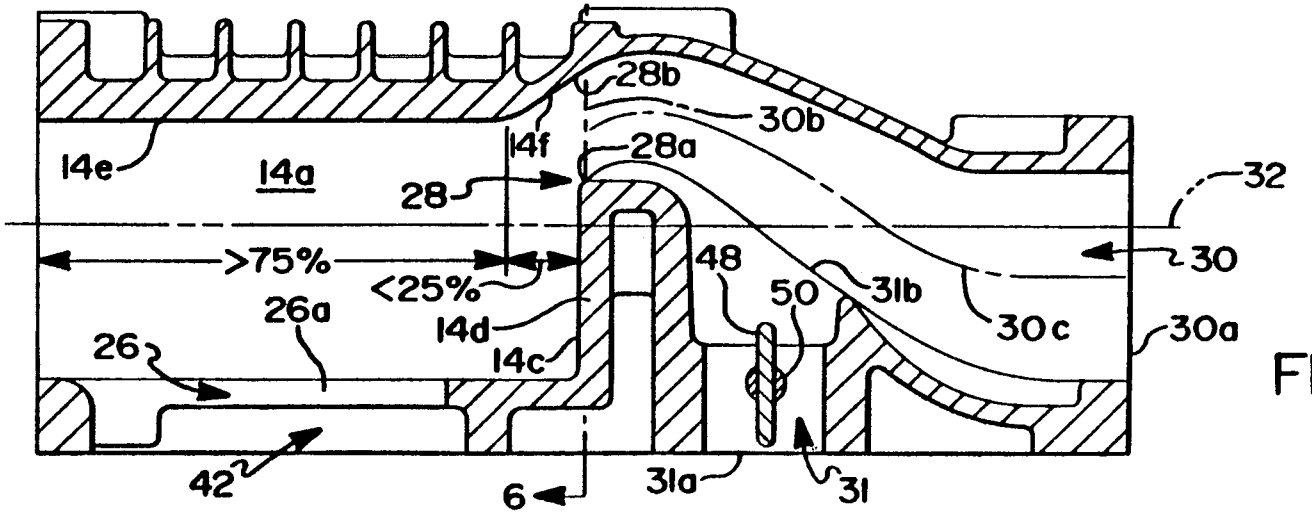
FIG. 4 is a longitudinal cross-sectional view of a housing member in FIGS. 1-3 looking along line 4—4 in FIG. 1.

The drawing figures illustrate a rotary pump or blower 10 of the Roots-type. Such blowers are used almost exclusively to pump or transfer volumes of compressible fluid, such as air, from an inlet port opening to an outlet port opening without compressing the air in the transfer volumes prior to exposure to high pressure air at the outer port opening. The rotors operate somewhat like gear-type pumps, i.e., as the rotor teeth or lobes move out of mesh, air flows into volumes or spaces defined by adjacent lobes on each rotor. The air in the volumes is then trapped between the adjacent lobes as the aft lobe thereof moves into a sealing relation with the wall surfaces of the chambers. The volumes of air are transferred or directly exposed to air at the outlet port opening when the fore lobe of each transfer volume traverses the boundaries of the outlet port opening or boundaries of ports or passages for preflowing or backflowing outlet port air at a controlled rate into the upcoming transfer volumes.

Blower 10 comprises a housing assembly 12 including a main housing member 14, a bearing plate member 16, and a drive housing member 18. The three members are secured together by a plurality of screws 20. The main housing member 14 is an unitary member defining cylindrical wall surfaces **14*a*,14*b* and a flat end surface 14*c* of an end wall 14*d* of first and second transversely overlapping cylindrical chambers 22,24. Member 14 also defines an outlet port opening 26, an inlet port opening 28, a main inlet duct 30, and a bypass duct 31**.

The other end wall of chambers 22,24 is defined by a flat surface **16*a* of bearing plate member 16. Chambers 22,24 respectively have parallel, longitudinal axes 22*a*,24*a* lying in a common plane 32. With reference to position in the drawings, the upper part of wall surfaces 14*a*,14*b* intersect to define a cusp 14*e* extending parallel to the chamber axes. As disclosed herein, the lower part of the surfaces 14*a*,14*b* do not actually intersect and are joined by a plane 33 parallel to plane 32 and tangent to surfaces 14*a*,14*b*. Chambers 22,24 respectively have rotors 34,36 mounted therein for counter rotation on shafts 38,40 having axes substantially coincident with the respective chamber axes. Shafts 38,40 are mounted at their opposite ends in known and unshown manner in antifriction bearings supported by bearing plate 16 and end wall 14*d*. The rotors are driven in the direction of arrows A and B by a drive pulley 41** fixed to a drive shaft which in turn drives unshown timing gears affixed to the rotor shafts. Details of mounting and driving the rotors, which form no part of the invention herein, may be obtained by reference to U.S. Pat. Nos. 4,595,349; 4,828,467 and 4,844,044, all of which are incorporated herein by reference.

Rotors 34,36 respectively include three lobes **34*a*,36*a* having an end-to-end helical twist of 60 rotational degrees. The lobes are circumferentially spaced apart by bottom lands 34*b*,36*b* at the lobe roots or radially inner extents. Each lobe includes oppositely facing end surfaces 34*c*,34*d* and 36*c*,36*d*, which sealingly cooperate with end wall surfaces 14*c*,16*a*, and top lands 34*e*,36*e* which sealingly cooperate with the cylindrical wall surfaces 14*a*,14*b* of the respective chamber. With respect to the direction of rotor rotation, end surfaces 34*c*,36*c* define trailing ends of the lobes and ends surfaces 34*d*,36*d*** define leading end of the lobes. In some forms of the invention herein the rotors may have less than or more than three lobes and the lobes may be other than helical, e.g., straight and parallel to the rotor axes. When helical lobes are employed they may have a twist defined by the relation 360°/2n, wherein n equals the number of lobes per rotor.

Outlet port opening 26 has a somewhat triangular shape disposed intermediate chambers 22,24 and skewed toward the ends of the chambers defined by flat surface **16*a* of the bearing plate member, and completely below common plane 32. Air from opening 26 flows into a rectangular recess 42 in the bottom or base of housing member 14. Preflow or backflow slots 44,46 disposed on opposite sides of the outlet port opening respectively provide for backflow of outlet air in recess 42 to transfer volumes of air trapped by adjacent unmeshed lobes of the rotor prior to traversal of the outlet port boundaries 26*a*,26*b* by the top land of the lead or fore lobe of each transfer volume. Further detail of the outlet port and backflow slots may be obtained by reference to previously mentioned U.S. Pat. No. 4,768,934 which is incorporated herein by reference. The base of housing member 14 is adapted to be affixed to an unshown manifold, such as an engine manifold, which directs outlet port air from recess 42 to engine combustion chambers and to an inlet 31*a* of bypass duct 31**.

Inlet port opening 28 has provided substantial improvement in volumetric efficiency of blower 10 even though the flow area thereof is no greater, and in many cases is less than, the flow area of prior art inlet port openings for Roots-type blowers of comparable displacement and rotor speeds.

Inlet port opening 28 extends through end wall **14*d* at a position completely above common plane 32 and adjacent end surfaces 34*d*,36*d* at the lead ends of the lobes. The opening includes radially inner and outer boundaries 28*a*,28*b* with respect to axes 22*a*,24*a* and first and second lateral boundaries 28*c*,28*d***.

Boundaries **28*a*,28*b* are positioned to maximize axial and minimize radial flow of inlet air into the spaces between adjacent lobes of each rotor. Such flow of inlet air mitigates negative effects of centrifugal forces imparted to the inlet air by the rotating lobes even at moderate rotor speeds. Further, since the inlet opening is at the lead ends of the helical lobes, the lobe helix angles impart axial forces on the inlet air which improves or assists flow into the spaces rather than opposes such flow as due centrifugal forces. Radially inner boundary 28*a* is positioned for substantial alignment with bottom lands 34*b*,36*b* of the lobes and radial outer boundary 28*b* is slightly outward of a tangent across the crest or uppermost arc of cylindrical surfaces 14*a*,14*b*. Housing 14 includes a surface 14*f* beginning at outer boundary 28*b* and smoothly tapering into cylindrical surfaces 14*a*,14*b* over an axial distance less than 25% of the axial length of chamber 22,24**.

Boundaries **28*c*,28*d* are positioned in circumferentially opposite directions from cusp 14*e* distances sufficient to be substantially untraversed by the aft lobe lead end surface of each transfer volume until the top land at the trailing end of the aft lobe traverses cusp 14*e***. This prior traversal of the cusp prevents a net air loss from substantially mature transfer volumes due to air flow across the top land to emerging transfer volumes at lower pressure.

Lateral boundaries **28*c*,28*d* may be, and in many applications, such as high rotor speed applications, are preferably, positioned for traversal as long after cusp traversal as possible, thereby increasing the number of rotational degrees each transfer volume is connected to inlet air. For example, with rotors having three 60 degree twist lobes each, lateral boundaries 28***c*,28*d* may be a minimum of about 60 degrees from cusp 14*e*. However, by extending the lateral boundaries to about 85 degrees, as shown in FIGS. 5–8, volumetric efficiency at high rotor speeds improved substantially while low speed volumetric efficiency was substantially unaffected.

Figure 6:
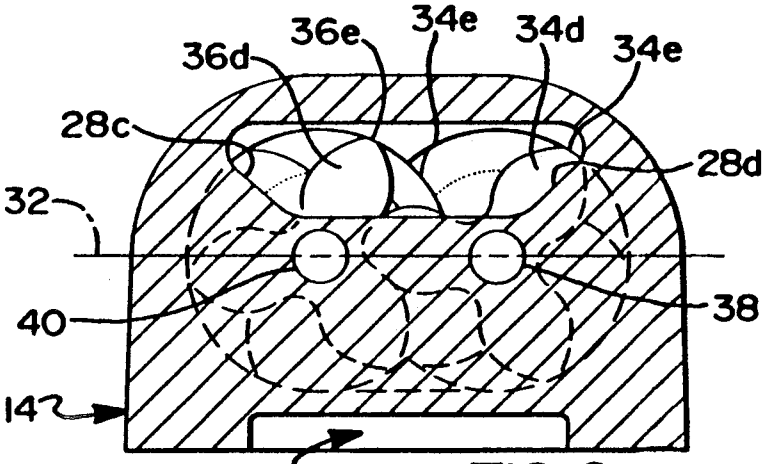
FIGS. 6-8 are reduced size, cross-sectional views of the blower inlet port opening looking along line 6—6 in FIGS. 3 and 4.
Figure 8:
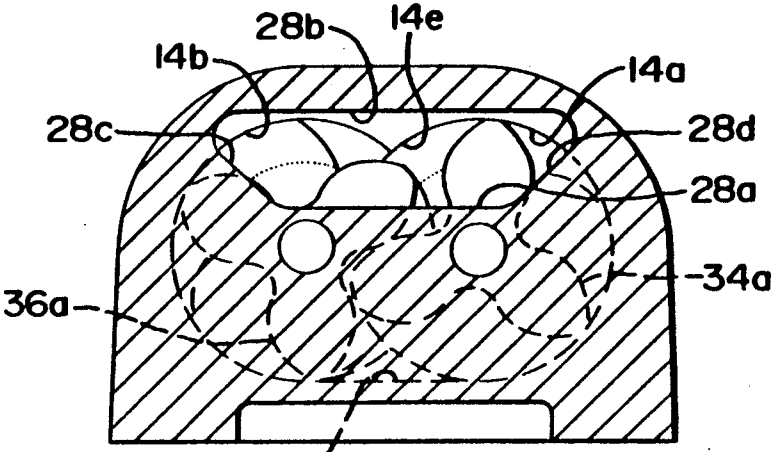
Figure 5:
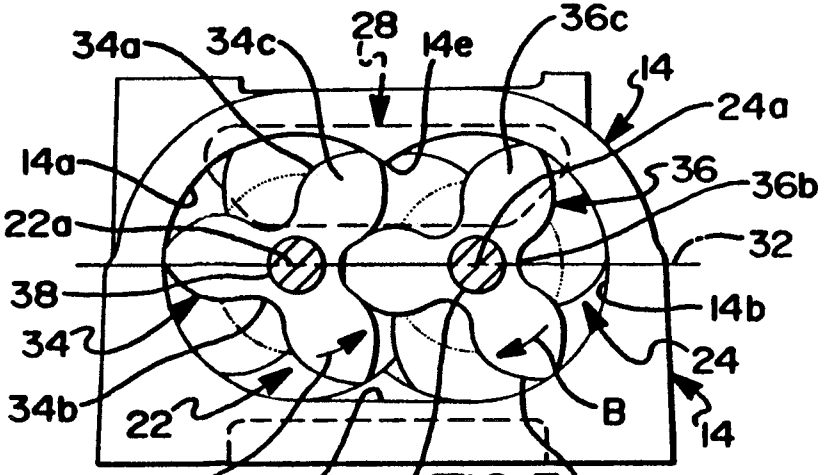
FIG. 5 is a cross-sectional view of the blower looking along line 5—5 in FIG. 3.
Figure 7:
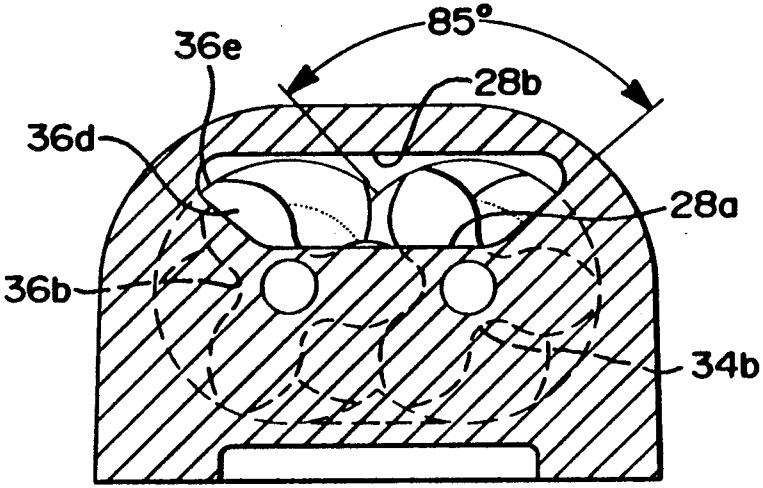
Figure 11:
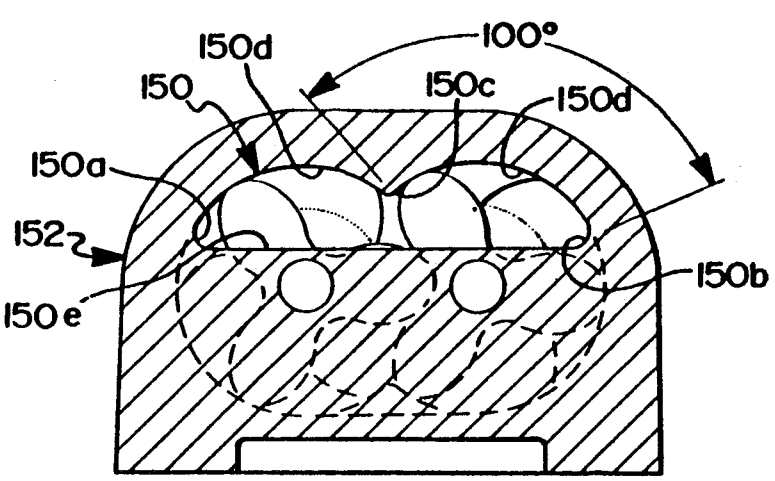
FIGS. 11 and 12 illustrate another alternative inlet port opening.
Figure 12:
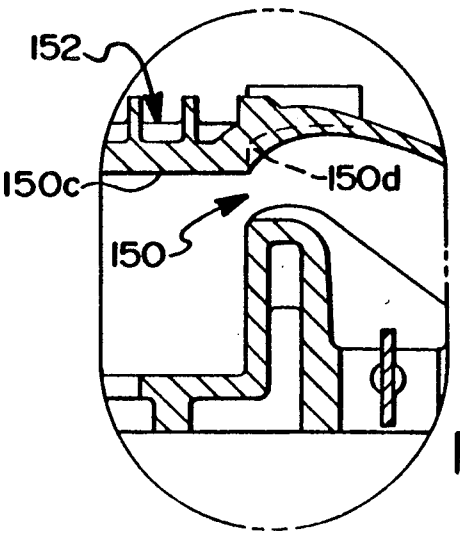
Figure 9:
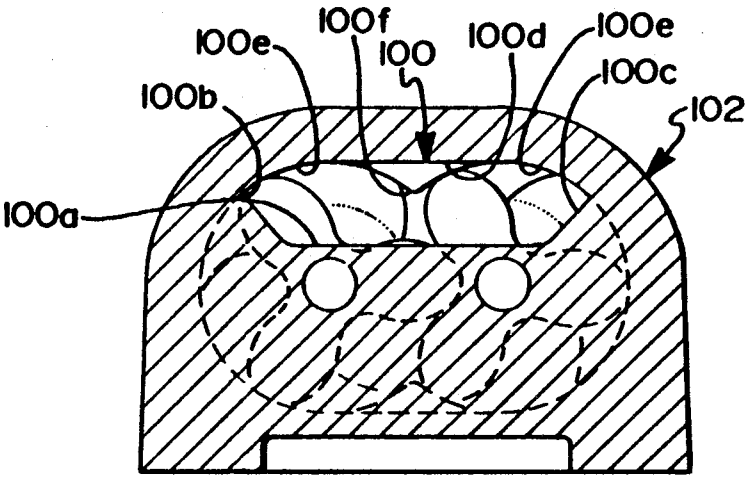
FIGS. 9 and 10 are reduced size, cross-sectional views respectively analogous to FIGS. 6 and 4, and illustrating an alternative inlet port opening.
Figure 10:
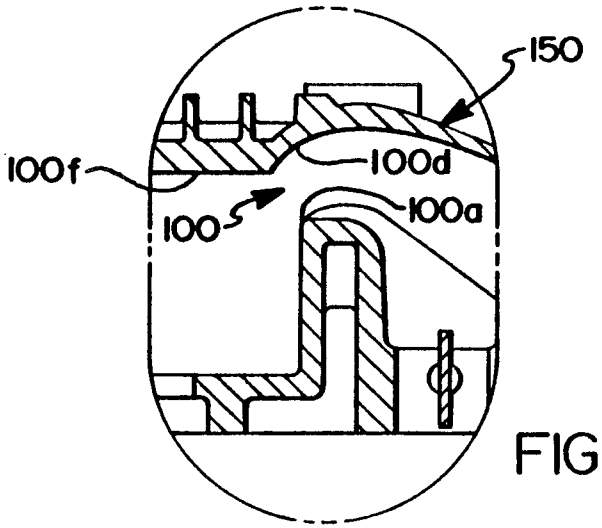

FIG. 6 shows a lobe end face 34*d* in the final stages of complete traversal of lateral boundary 28*d* and the top lands 38*e* thereof having completely traversed cusp 14*e*. FIG. 7 illustrate substantially the same condition for rotor 36. FIG. 8 illustrates intermediate position of the lobes.

Looking now briefly at FIGS. 9, 10 and 11, 12, therein are shown alternative inlet port openings 100,150 defined respectively by housing members 102,152, which housings are otherwise the same as housing member 14. Opening 100 in FIGS. 9, 10 has a radially inner boundary 100*a* and lateral boundaries 100*b*,100*c* which are respectively the same as boundaries 28*a*,28*c*,28*d* in FIGS. 4–8. A radially outer boundary of opening 100 includes a center portion 100*d* defined by a tangent to the cylindrical surfaces of the rotor chambers and arcuate portions 100*e* axially aligned with and following the curvature of the surfaces between the tangents and the lateral boundaries. The portion of the housing between center portion 100*d* and a cusp 100*f* is relieved or tapered at an angle of about 45 degrees. Opening 150 in FIGS. 11, 12 differs from openings 28 and 100 in that lateral boundaries 150*a*,150*b* thereof are positioned about 100 rotational degrees from a cusp 150*c* and radially outer boundary 150*d* is continuously aligned with the cylindrical surfaces of the rotor chamber. Various combinations of the inlet port openings are also readily provided by merely exchanging the outer or lateral boundaries of the openings.

Referring again to FIGS. 1–4, inlet duct 30 includes an end 30*a* adapted to be connected to a source of air in known manner and an end 30*b* defined by inlet port opening 28. Duct 30 has a mean flow path represented by phantom line 30*c* which is disposed below plane 32 at end 30*a*, curves upward across plane 32, and curves slightly downward for smooth transition into inlet port opening 28. Bypass duct 31 includes an inlet 31*a* adapted to receive blower discharge air as previously mentioned, a butterfly valve 48 for controlling bypass air flow in known manner, and an outlet 31*b* which directs the bypass air into inlet duct 30 at an acute angle with respect to the air flow in the inlet duct. This blending of inlet and bypass air reduces air turbulences in passage 30 therefore mitigates inefficiencies associated with bypass air flow into an inlet duct of a supercharger. The butterfly is affixed to a shaft 50 which is rotated by a link 52. The link is spring loaded in a direction closing the butterfly and moved toward positions opening the butterfly by a vacuum motor 54 or the like in known manner.

Several embodiments of the invention have been disclosed herein for illustrative purposes. Many variations of the disclosed embodiments, beyond those previously mentioned herein, are believed to be within the spirit of the invention. For example, the radial inner boundaries of the inlet ports may have arc portions in alignment with the arc traced by the path of the bottom lands between the rotor lobes. The following claims are intended to cover inventive portions of the disclosed embodiment and modifications believed to be within the spirit of the invention.

What is claimed is:

1. A Roots-type blower comprising:

a housing assembly defining first and second transversely overlapping cylindrical chambers having internal cylindrical and flat end wall surfaces the chambers having transversely spaced apart parallel central axes lying in a common plane, an intersection of the cylindrical wall surfaces on one side of the plane defining a cusp extending parallel to the axes, and the housing defining inlet and outlet port openings disposed on opposite sides of the plane for respectively directing air to and from the chambers with the inlet port opening extending through one end wall of the chambers;

first and second meshed, lobed rotors respectively disposed in the chambers for counter rotation about axes substantially coincident with the chamber axes, each rotor including at least two lobes of substantially like profile with radially inner extents thereof separated by bottom lands, each lobe having axially facing ends sealingly cooperating with the end wall surfaces and a radially outer extent defining a top land sealingly cooperating with the cylindrical wall surfaces, and circumferential spacing between fore and aft adjacent unmeshed lobes of each rotor defining a transfer volume for transferring air from the inlet port opening to the outlet port opening in less than one full rotation of each rotor; characterized by:

the inlet port opening being disposed on the cusp side of the plane and including radially inner and outer boundaries with respect to the axes and first and second lateral boundaries each disposed about a minimum of 60 rotational degrees in opposite directions from the cusp, the radially inner boundary having portions disposed for substantial alignment with rotating bottom lands of the respective rotors, the radially outer boundary between the lateral boundaries including portions disposed radially outward of a tangent extending across cylindrical surfaces of the chambers, and the chamber cylindrical wall surfaces between the lateral boundaries extending axially from the other end wall surface to within less than 25% of the distance to the one end wall surface and then tapering radially outward for blending with the portions of the radially outer boundary.

2. The blower of claim 1, wherein:

the lobes are formed with a helical twist and therefore one end of each lobe being a leading end and the other end being a trailing end in the direction of rotor rotation; and the inlet port opening being defined in the end wall disposed at the leading ends of the lobes, and the lateral boundaries being positioned for traversal by the axially facing end of each aft lobe after the top land at the trailing end of the aft lobe substantially traverses the cusp.

3. The blower of claim 2, wherein the helical twist is formed according to the relation 360°/2n, where n equals the number of lobes per rotor.

4. The blower of claim 1, further including:

a main duct having a first end defined by the inlet port opening and a second end axially spaced from the first end for receiving atmospheric air; and a bypass duct having an inlet for receiving blower discharge air and an outlet intersecting the main duct intermediate the ends thereof, the bypass outlet disposed to direct bypass air into the main duct at an acute angle with respect to air flow in the main duct.

5. The blower of claim 4, wherein:

the lobes are formed with a helical twist and therefore one end of each lobe being a leading end and the other end being a trailing end in the direction of rotor rotation; and the inlet port opening being defined in the end wall disposed at the leading ends of the lobes, and the lateral boundaries being positioned for traversal by the axially facing end of each aft lobe after the top land at the trailing end of the aft lobe substantially traverses the cusp.

6. The blower of claim 5, wherein the helical twist is formed according to the relation 360°/2n, wherein n equals the number of lobes per rotor.

7. The blower of claim 4, wherein the housing assembly includes an unitary housing member defining the cylindrical walls, the one end wall, the inlet and outlet port openings, the main duct, and the bypass duct.

8. The blower of claim 7, wherein:

the lobes are formed with a helical twist and therefore one end of each lobe being a leading end and the other end being a trailing end in the direction of rotor rotation; and the inlet port opening being defined in the end wall disposed at the leading ends of the lobes, and the lateral boundaries being positioned for traversal by the axially facing end of each aft lobe after the top land at the trailing end of the aft lobe substantially traverses the cusp.

9. The blower of claim 8, wherein the helical twist is formed according to the relation 360°/2n, wherein n equals the number of lobes per rotor.

* * * * *